US008944778B2

(12) United States Patent
Lappalainen

(10) Patent No.: US 8,944,778 B2
(45) Date of Patent: Feb. 3, 2015

(54) LIQUID RING PUMP AND METHOD FOR OPERATING A LIQUID RING PUMP

(75) Inventor: Vesa Lappalainen, Vantaa (FI)

(73) Assignee: Evac International Oy, Espoo (FI)

( * ) Notice: Subject to any disclaimer, the term of this patent is extended or adjusted under 35 U.S.C. 154(b) by 0 days.

(21) Appl. No.: 13/640,504

(22) PCT Filed: Mar. 31, 2011

(86) PCT No.: PCT/FI2011/050276

§ 371 (c)(1),
(2), (4) Date: Dec. 20, 2012

(87) PCT Pub. No.: WO2011/128502

PCT Pub. Date: Oct. 20, 2011

(65) Prior Publication Data

US 2013/0089440 A1 Apr. 11, 2013

(30) Foreign Application Priority Data

Apr. 14, 2010 (FI) ..... 20105386

(51) Int. Cl.
*F04C 19/00* (2006.01)
*F04C 7/00* (2006.01)
(Continued)

(52) U.S. Cl.
CPC ..... *F04C 7/00* (2013.01); *F04C 19/005* (2013.01); *F04C 27/009* (2013.01); *F04D 3/02* (2013.01); *F04C 29/12* (2013.01); *F04C 2250/02* (2013.01)
USPC ..... 417/68; 4/431

(58) Field of Classification Search
CPC ..... F04C 19/00; F04C 19/01; F04C 19/004
USPC ..... 417/68, 65, 66; 4/431, 432–433; 415/72, 111, 112, 174.2, 231
See application file for complete search history.

(56) References Cited

U.S. PATENT DOCUMENTS 3,771,898 A 11/1973 Segebrecht
4,498,844 A * 2/1985 Bissell et al. ..... 417/68
(Continued)

FOREIGN PATENT DOCUMENTS

DE 3421866 A1 12/1985
DK 9200177 U3 2/1993
(Continued)

OTHER PUBLICATIONS

Search Report dated Feb. 7, 2011 in Finland Application No. 20105386.
(Continued)

*Primary Examiner* — Devon Kramer
*Assistant Examiner* — Patrick Hamo
(74) *Attorney, Agent, or Firm* — Kilpatrick Townsend & Stockton LLP; Dean W. Russell, Esq.; Kristin M. Crall, Esq.

(57) ABSTRACT

The invention relates to a liquid ring pump (1) for generating vacuum and for pumping a flow of sewage in a vacuum sewage system. The liquid ring pump comprises in the direction of the flow of sewage a pump inlet (11), an inlet chamber (13), a pump housing (14) provided with a rotor (15) arranged on a drive shaft (16) provided with a mechanical seal (20), an outlet chamber (17), and an pump outlet (19). The mechanical seal (20) is arranged within the outlet chamber (17). The outlet chamber (17) is provided with an integrated extension (18) providing an enlargement of the outlet chamber (17) in order to retain the flow of sewage in the outlet chamber (17) before it is discharged from the pump outlet (19) in order to improve the lubrication of the mechanical seal (20).

8 Claims, 6 Drawing Sheets

(51) Int. Cl.

| | |
|---|---|
| ***F04C 27/00*** | (2006.01) |
| ***F04D 3/02*** | (2006.01) |
| *F04C 29/12* | (2006.01) |

(56) References Cited

U.S. PATENT DOCUMENTS

| | | | | |
|---|---|---|---|---|
| 4,710,105 | A | 12/1987 | Segebrecht et al. | |
| 5,344,085 | A * | 9/1994 | Hofseth | 241/46.02 |
| 5,735,674 | A * | 4/1998 | Domagalla et al. | 417/68 |
| 6,354,808 | B1 | 3/2002 | Shenoi et al. | |
| 7,029,231 | B2 * | 4/2006 | Hofseth | 415/72 |

FOREIGN PATENT DOCUMENTS

| | | | |
|---|---|---|---|
| EP | 0494041 | A1 | 7/1992 |
| EP | 0766988 | A1 | 4/1997 |
| EP | 2078792 | A1 | 7/2009 |
| EP | 2090783 | A2 | 8/2009 |
| EP | 2090783 | A3 | 8/2009 |
| WO | 9910123 | A1 | 9/1990 |
| WO | 02097275 | A1 | 12/2002 |
| WO | 2004099619 | A1 | 11/2004 |

OTHER PUBLICATIONS

International Search Report and Written Opinion dated Apr. 11, 2012 in Application No. PCT/FI2011/050276.

International Preliminary Report on Patentability dated Aug. 29, 2012 in Application No. PCT/FI2011/050276.

* cited by examiner

LIQUID RING PUMP AND METHOD FOR OPERATING A LIQUID RING PUMP

CROSS REFERENCE TO RELATED APPLICATIONS

This application is the U.S. national phase of International Application No. PCT/FI2011/050276 filed on Mar. 31, 2011, and published in English on Oct. 20, 2011 as International Publication No. WO2011/128502 A2, which application claims priority to Finnish Patent Application No. 20105386 filed on Apr. 14, 2010, the contents of both of which are incorporated herein by reference.

TECHNICAL FIELD

The invention relates to a liquid ring pump for generating vacuum and for pumping a flow of sewage in a vacuum sewage system, which liquid ring pump comprises in the direction of the flow of sewage a pump inlet, an inlet chamber, a pump housing provided with a rotor arranged on a drive shaft provided with a mechanical seal, an outlet chamber, and a pump outlet, which pump inlet is arranged to be connected to a collector for receiving the flow of sewage, and which pump outlet is arranged to be connected to a discharge pipe for discharging the flow of sewage, according to preamble of claim 1. The invention also relates to a method for operating a liquid ring pump.

BACKGROUND ART

A typical arrangement in fluid pumps, such as liquid ring pumps, is to employ mechanical seals for replacing packed glands and lip seals. Mechanical seals are provided to prevent pumped fluids from leaking out along the drive shafts. However, in known fluid pumps, a common problem is mechanical seal lifetime, which naturally influences the reliability of the fluid pump. Particularly in vacuum sewage systems where the flow of sewage is very turbulent the mechanical seal normally runs in very dry conditions, whereby the mechanical seal is subject to high risks of damage.

SUMMARY OF INVENTION

An object of the present invention is to avoid the above mentioned problems and to achieve a liquid ring pump with an extended life time. This object is attained by a liquid ring pump according to claim 1 and a method for operating a liquid ring pump according to claim 10.

The basic idea of the invention is to provide an inherent lubricant during the operation of the liquid ring pump. This is realized in that the mechanical seal is arranged within the outlet chamber. The outlet chamber is provided with an integrated extension and the pump outlet is arranged at the downstream end of the integrated extension in the direction of the flow of sewage. This retains a steady and sufficient flow of lubricant, i.e. sewage water, over the mechanical seal, particularly when the pump is running, i.e. operated. As the outlet chamber has an integrated extension which enlarges the outlet chamber, i.e. gives the outlet chamber a larger volume in comparison to an outlet chamber of a standard liquid ring pump, such an enlarged outlet chamber contains a greater amount of sewage water ensuring appropriate lubrication of the mechanical seal.

An advantageous result of this arrangement is that the mechanical seal is arranged to be lubricated by the flow of sewage, i.e. sewage water, as the flow of sewage flows into and through the outlet chamber and the integrated extension of the outlet chamber before it is discharged from the pump outlet.

The integrated extension of the outlet chamber thus provides a direct continuation and enlargement of the outlet chamber, in which the sewage flow is received from the pump housing before it is discharged from the pump outlet. This ensures an enhanced lubrication of the mechanical seal all the time the liquid ring pump is running.

An advantageous arrangement to improve the lubrication effect of sewage water is to provide the outlet chamber with an axial vane extending over a part of the length of the drive shaft and along the drive shaft in the outlet chamber in the direction of the flow of sewage so that the axial vane is arranged to direct the flow of sewage along and towards the mechanical seal as the flow of sewage flows through the outlet chamber.

An advantageous alternative arrangement to improve the lubrication effect of sewage water is to provide the outlet chamber with a radial vane extending around a part of the circumference of the drive shaft and extending over a part of the length of the drive shaft in the outlet chamber in the direction of the flow of sewage so that the radial vane is arranged to direct the flow of sewage around and towards the mechanical seal as the flow of sewage flows through the outlet chamber.

A further advantageous arrangement is to provide the integrated extension of the outlet chamber with a flange means extending over a part of the integrated extension in the direction of the drive shaft and downstream of the outlet chamber in the direction of the flow of sewage. This obstructs and redirects the flow of sewage toward the outlet chamber and thus improves the lubrication of the mechanical seal.

For ensuring an efficient operation of the liquid ring pump, the pump inlet is provided with a back-flow valve means.

In order to avoid flow problems in the liquid ring pump, the liquid ring pump advantageously comprises a macerator device upstream of the pump housing.

The present invention is particularly advantageous when the liquid ring pump is deployed in a vacuum sewage system, which comprises a source of sewage, vacuum piping including the collector, a discharge valve arranged between the vacuum piping and the source of sewage, and a receiving facility for receiving the flow of sewage from the discharge pipe.

Further advantageous features of the present invention are given in claims 2-9 and 11-15.

BRIEF DESCRIPTION OF DRAWINGS

In the following the invention will be described, by way of example only, in more detail with the reference to the attached schematic drawings, in which.

DETAILED DESCRIPTION

Figure 1:
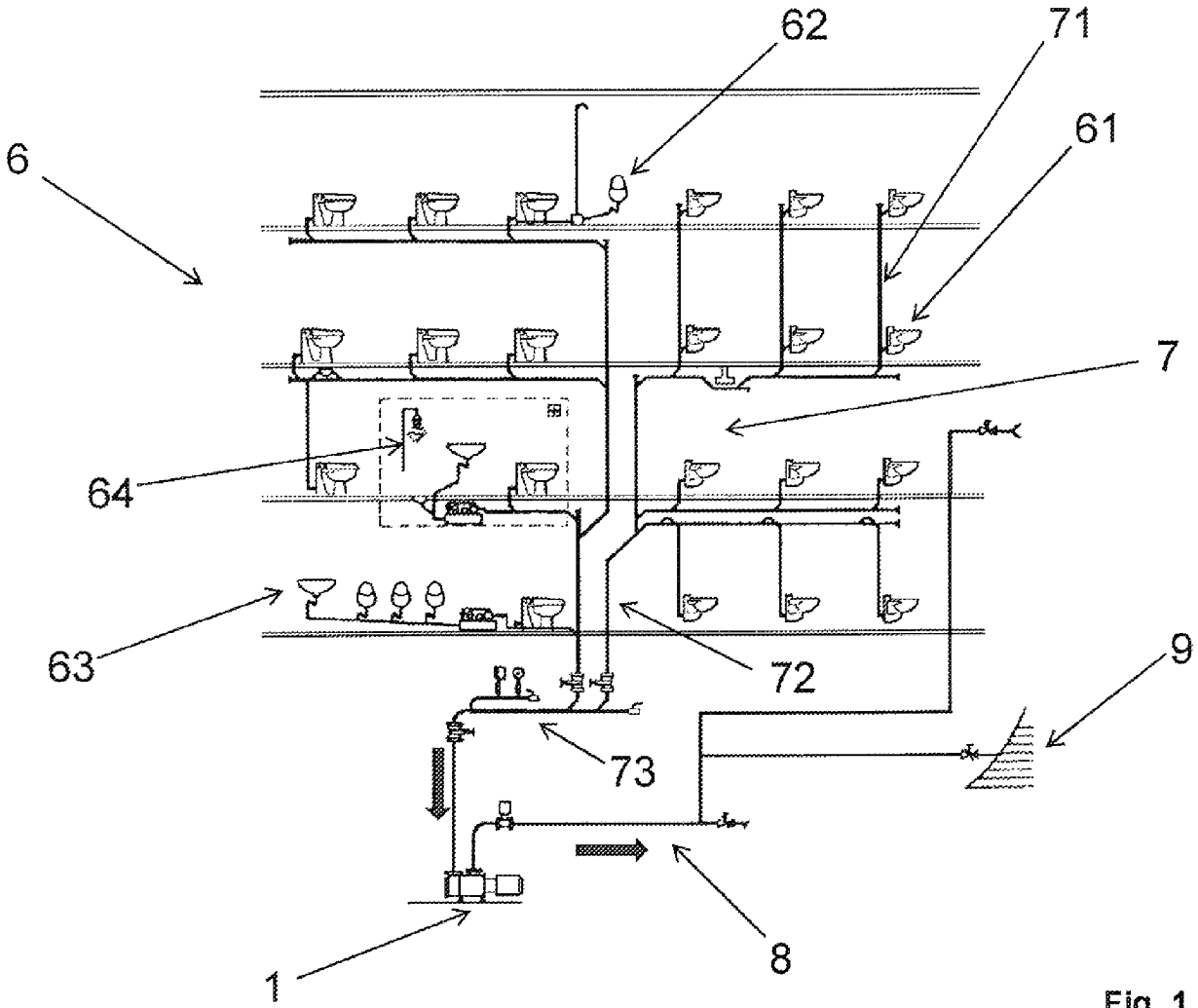
FIG. 1 illustrates a general layout of a vacuum sewage system as an example for employing a liquid ring pump according to the present invention.

FIG. 1 illustrates a general lay-out of a vacuum sewage system 6. The vacuum sewage system comprises a source of sewage, in this embodiment a number of sources of sewage, such as toilets 61, urinals 62, wash basins 63, and showers 64. The vacuum sewage system further comprises vacuum piping 7 including branch pipes 71, main lines 72 and a collector 73. The sources of sewage, such as the toilets 61, are connected to the vacuum piping, or in this embodiment to the branch pipes 71, through discharge valves (not shown) arranged between the source of sewage and the vacuum piping. A liquid ring pump 1 is connected to the collector 73 for generating vacuum and for pumping a flow of sewage in the vacuum sewage system. The liquid ring pump 1 is further connected to a discharge pipe 8 for discharging the flow of sewage to a receiving facility 9. For a vacuum sewage system aboard a marine vessel, the discharge facility could be e.g. a surrounding sea, a storage tank or a treatment plant. The flow of sewage is in the substantially in the form of sewage water.

Vacuum sewage systems of this kind are well known in the art and by a person skilled in the art and are therefore not discussed in greater deal in this connection.

The direction of the flow of sewage is indicated with block arrows.

Figure 2:
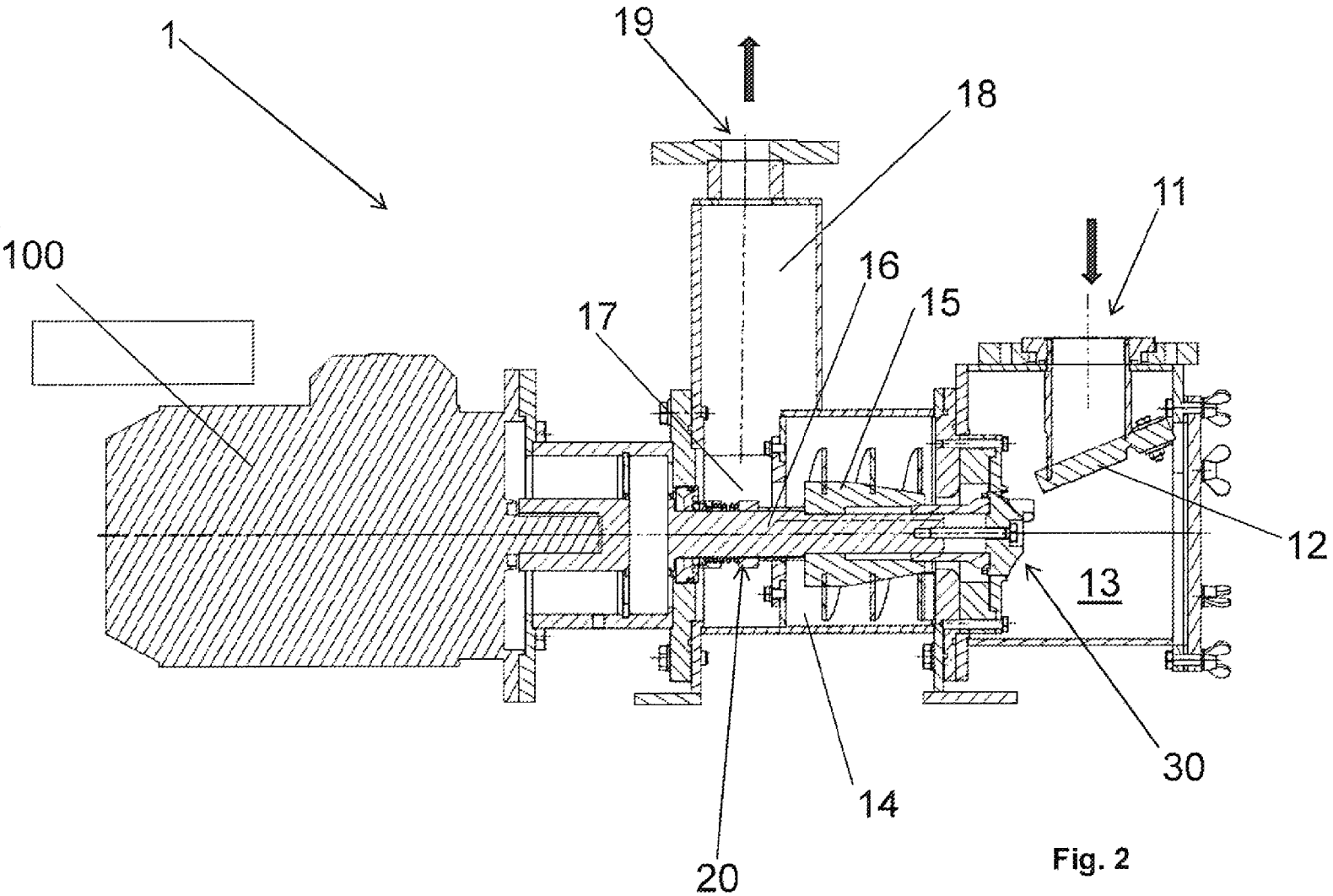
FIG. 2 shows a first embodiment the present invention.

FIG. 2 shows a first embodiment of a liquid ring pump 1 according to the present invention in more detail. The liquid ring pump 1 comprises in the direction of the flow of sewage (indicated by block arrows) a pump inlet 11 provided with a back-flow valve 12, an inlet chamber 13, a pump housing 14 provided with a screw rotor 15 arranged on a drive shaft 16 provided with a mechanical seal 20, an outlet chamber 17, and a pump outlet 19. The inlet 11 is arranged to be connected to the collector 73 as described in connection with FIG. 1. The pump outlet 19 is arranged to be connected to the discharge pipe 8 as described in connection with FIG. 1. The liquid ring pump 1 is driven by an electric motor 100 arranged at the outlet side of the liquid ring pump.

The mechanical seal 20 of the drive shaft 16 is arranged within the outlet chamber 17. The mechanical seal 20 is provided in order to prevent pumped fluids, in this case sewage collected and pumped from the various sources of sewage of the vacuum sewage system, from leaking out along the drive shaft 16 as the sewage is pumped through the liquid ring pump 1. In this embodiment the outlet chamber 17 is provided with an integrated extended volume in the form of an integrated extension 18. The integrated extension 18 extends over the outlet chamber 17 and a part of the pump housing 14 in the direction of the drive shaft 16. The pump outlet 19 is arranged at the downstream end of the integrated extension 18 in the direction of the flow of sewage (indicated by block arrows).

The integrated extension 18 of the outlet chamber 17 thus provides a direct continuation and enlargement of the outlet chamber 17, in which the sewage flow is received from the pump housing 16 before it is discharged from the pump outlet 19. This ensures an enhanced lubrication of the mechanical seal 20 all the time the liquid ring pump 1 is running.

The liquid ring pump 1 comprises a macerator device 30 upstream of the pump housing 14 for macerating any solids or the like in the flow of sewage. This helps to ensure that no blockage in the flow of sewage occurs when the vacuum system is in operation.

Figure 3:
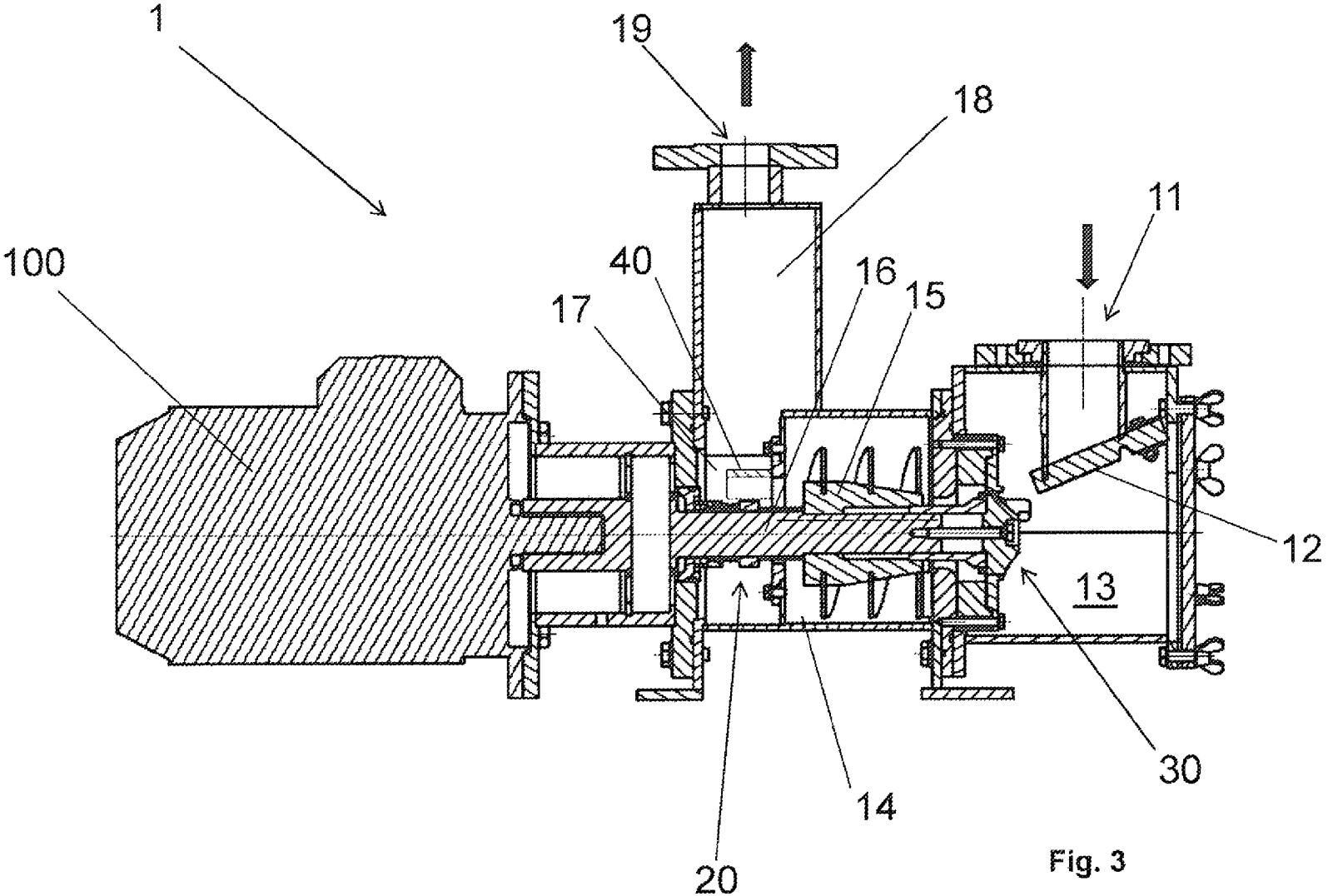
FIG. 3 shows a second embodiment of the present invention.

FIG. 3 shows a second embodiment of a liquid ring pump 1 according to the present invention in more detail. This embodiment corresponds to the embodiment described in FIG. 2 above, whereby the corresponding elements are indicated by the same reference numerals as in FIG. 2. This embodiment further includes an axial vane 40, which extends in the direction of the drive shaft 16 from the downstream end of the pump housing 14 along the drive shaft 16 at a given distance from the drive shaft 16. This improves the distribution of the sewage flow, i.e. the lubricating sewage water, over the mechanical seal 20 as the sewage flow passes out from the pump housing 14 and into and through the outlet chamber 17 towards the integrated extension 18 and the pump outlet 19. The direction of the sewage flow is indicated by block arrows.

Figure 4:
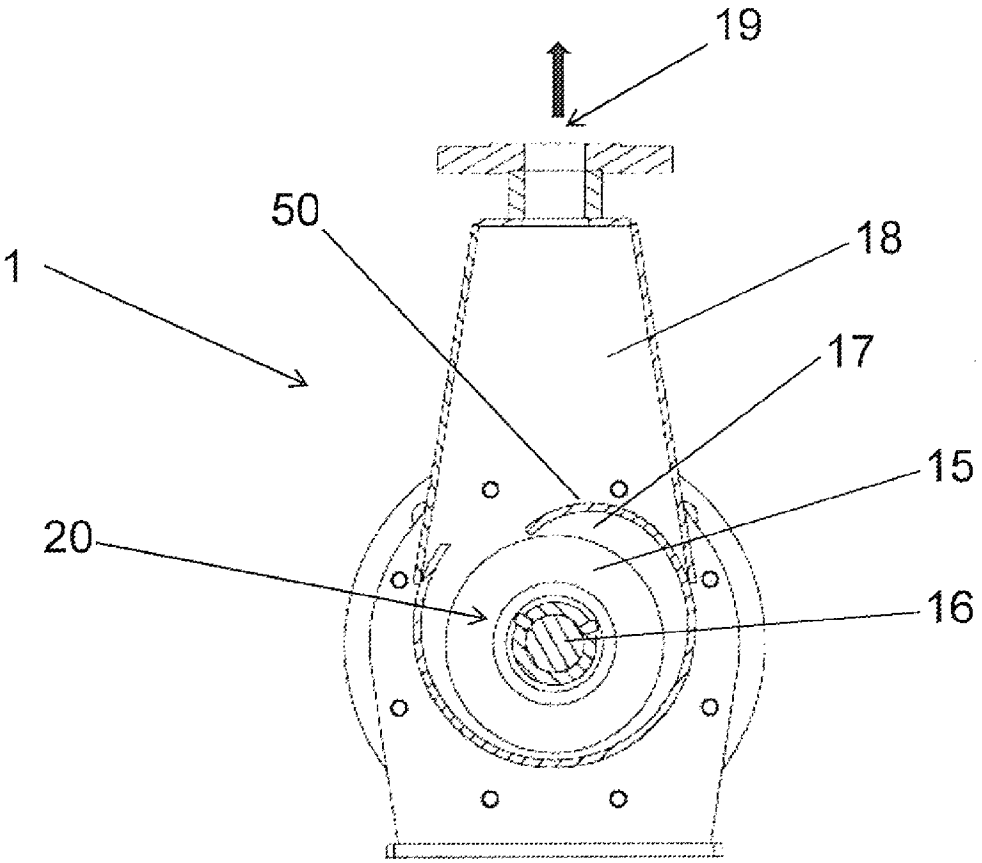
FIG. 4 shows a third embodiment of the present invention.

FIG. 4 shows a third embodiment of a liquid ring pump 1 according to the present invention in more detail and in cross section. This embodiment corresponds to the embodiment described in FIG. 2 above, whereby the corresponding elements are indicated by the same reference numerals as in FIG. 2. This embodiment further includes a radial vane 50, which is arranged in a radial direction around the circumference of the drive shaft 16. The radial vane 50 extends in the direction of the drive shaft 16 from the downstream end of the pump housing 14 in the outlet chamber 17, whereby the radial vane 50 extends along the drive shaft 16 in the direction of the sewage flow. This improves the distribution of the sewage flow, i.e. the lubricating sewage water, over the mechanical seal 20 as the sewage flow passes out from the pump housing 14 and into and through the outlet chamber 17 towards the integrated extension 18 and the pump outlet 19. The direction of the sewage flow is indicated by block arrows.

Figure 5:
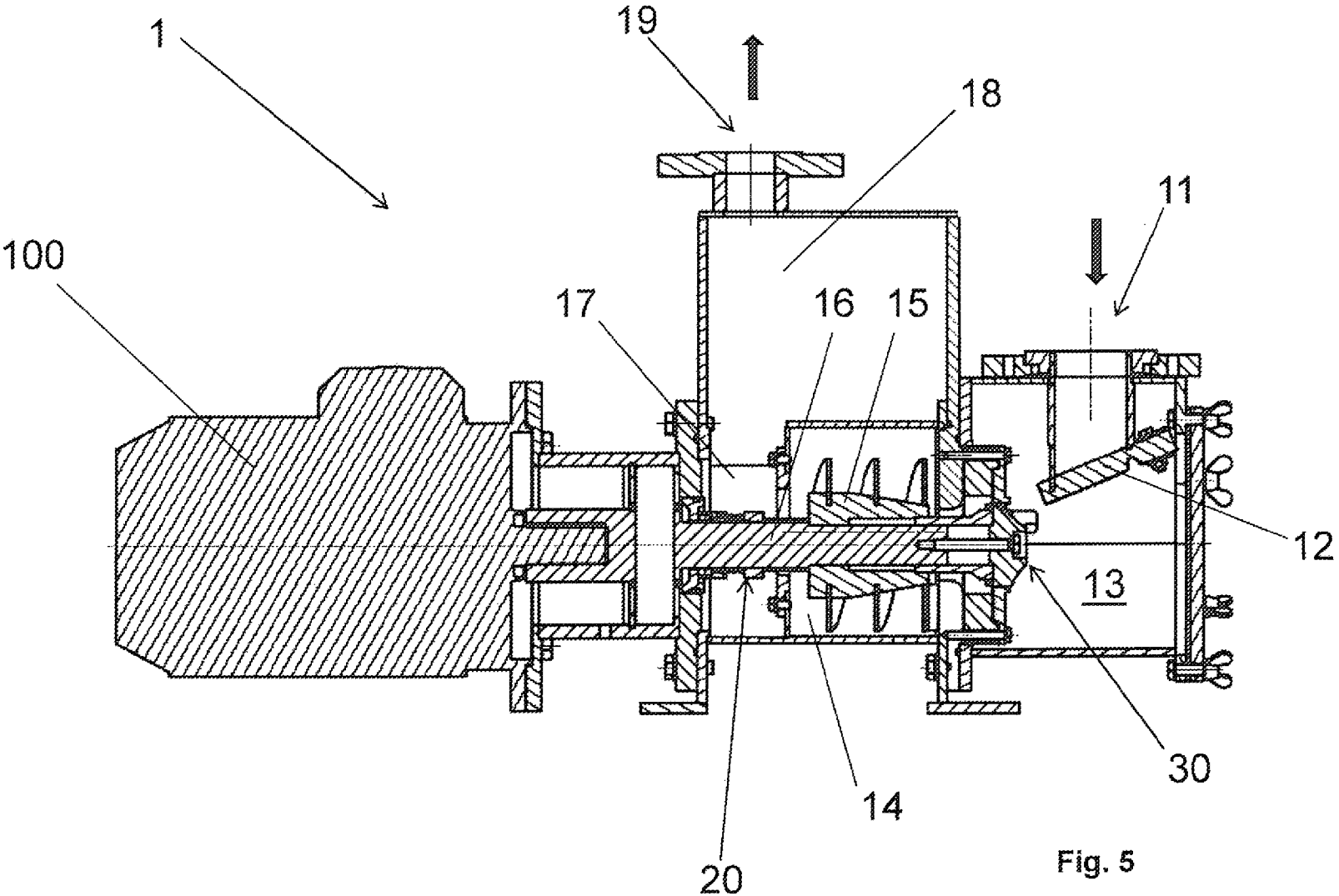
FIG. 5 shows a fourth embodiment of the present invention.

FIG. 5 shows a fourth embodiment of a liquid ring pump 1 according to the present invention in more detail. This embodiment corresponds to the embodiment described in FIG. 2 above, whereby the corresponding elements are indicated by the same reference numerals as in FIG. 2. In this embodiment, however, the integrated extension 18 is provided with a different configuration. The integrated extension 18 provides an extended volume extending over the pump housing 14 and over the outlet chamber 17 in the direction of the drive shaft 16. In comparison with the integrated extension illustrated in connection with FIGS. 2-4, the extension has a further enlarged volume enhancing the retention of the sewage water in the enlarged volume formed by the outlet chamber 17 and its integrated extension 18 for lubrication purposes of the mechanical seal 20. The integrated extension 18 of the outlet chamber 17 thus provides a direct continuation and enlargement of the outlet chamber 17, in which the sewage flow is received from the pump housing 16 before it is discharged from the pump outlet 19. This ensures an enhanced lubrication of the mechanical seal 20 all the time the liquid ring pump 1 is running.

The liquid ring pump 1 comprises a macerator device 30 upstream of the pump housing 14 for macerating any solids or the like in the flow of sewage. The liquid ring pump 1 is driven by an electric motor 100 arranged at the outlet side of the liquid ring pump. The direction of the sewage flow is indicated by block arrows.

Figure 6:
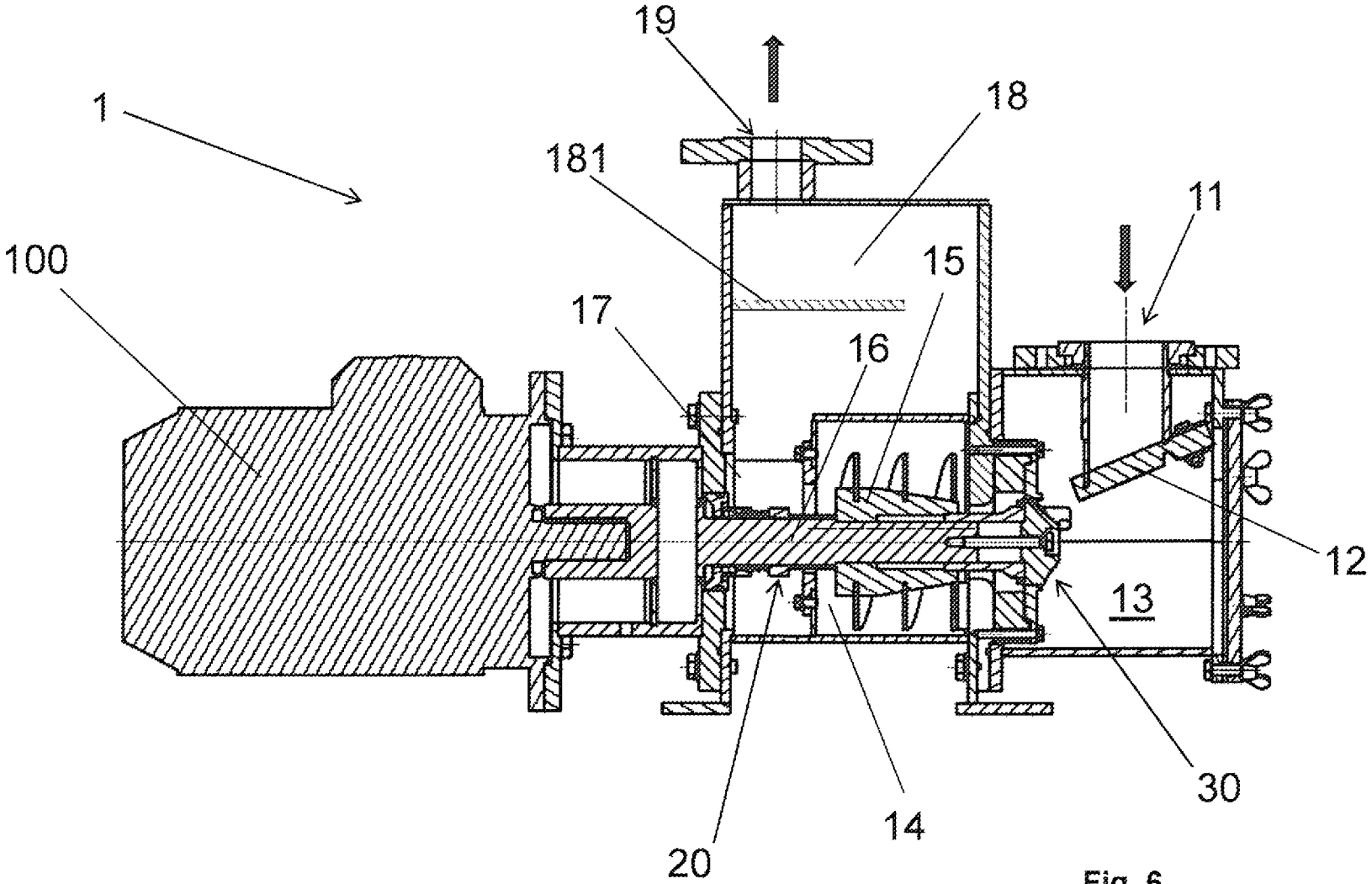
FIG. 6 shows a fifth embodiment of the present invention.

FIG. 6 shows a fifth embodiment of a liquid ring pump 1 according to the present invention in more detail. This embodiment corresponds to the embodiment described in FIG. 5 above, whereby the corresponding elements are indicated by the same reference numerals as in FIG. 2. This fifth embodiment comprises, in comparison the fourth embodiment described in FIG. 5 above, a flange means 181 arranged in the integrated extension 18 of the outlet chamber 17, in order to redirect and retain the flow of sewage in the area of the outlet chamber 17 and the integrated extension 18 before it is discharged from the pump outlet 19. The flange means 181 thus obstructs the flow of sewage downstream of the outlet chamber 17. The flange means 181 is arranged to extend in the direction of the drive shaft 16 of the liquid ring pump 1, over a substantial part of the length (in the direction of the drive shaft 16) of the integrated extension 18 of the outlet chamber 17 and at a given distance downstream of the drive shaft 16. This further improves the lubrication of the mechanical seal 20 on the drive shaft 16 as the sewage flow is retained and partly flushed back over the mechanical seal 20 during the obstructed flow of sewage through the outlet chamber 17 and the integrated extension 18 of the outlet chamber 17.

The description and the thereto related drawings are only intended to clarify the basic idea of the invention. The invention may vary in detail within the scope of the ensuing claims.

The invention claimed is:

1. A liquid ring pump for generating vacuum and for pumping a flow of sewage in a vacuum sewage system, wherein the liquid ring pump comprises, in the direction of the flow of sewage, a pump inlet, an inlet chamber, a pump housing provided with a rotor arranged on a drive shaft, an outlet chamber, the drive shaft extending from the housing into the outlet chamber, the drive shaft having a mechanical seal, wherein the mechanical seal is arranged on a portion of the drive shaft that passes through the outlet chamber, an integrated extension comprising an extended volume extending from the outlet chamber, the integrated extension having a width that extends over the outlet chamber, wherein the integrated extension provides a continuation and enlargement of the outlet chamber extending toward a pump outlet, and the pump outlet arranged at an end of the integrated extension, in the direction of the flow of sewage, wherein the pump inlet is arranged to be connected to a collector for receiving the flow of sewage, wherein the pump outlet is arranged to be connected to a discharge pipe for discharging the flow of sewage, and wherein the mechanical seal is arranged to be lubricated by the flow of sewage as the flow of sewage flows from the pump housing into and through the outlet chamber and the integrated extension of the outlet chamber from where it is discharged through the pump outlet into the discharge pipe.

2. The liquid ring pump according to claim 1, wherein the outlet chamber is provided with an axial vane extending over a part of a length of the drive shaft in the outlet chamber in the direction of the flow of sewage.

3. The liquid ring pump according to claim 1, wherein the outlet chamber is provided with a radial vane extending around a part of the drive shaft in the outlet chamber in the direction of the flow of sewage.

4. The liquid ring pump according to claim 1, wherein the integrated extension of the outlet chamber is provided with a flange means extending over a part of the integrated extension in the same direction as the drive shaft and downstream of the outlet chamber in the direction of the flow of sewage.

5. The liquid ring pump according to claim 1, wherein the pump inlet is provided with a back-flow valve means.

6. The liquid ring pump according to claim 1, wherein the liquid ring pump comprises a macerator device upstream of the pump housing.

7. The liquid ring pump according to claim 1, wherein the liquid ring pump is deployed in the vacuum sewage system, which comprises a source of sewage, vacuum piping including the collector, a discharge valve arranged between the vacuum piping and a source of sewage, and a receiving facility for receiving the flow of sewage from the discharge pipe.

8. The liquid ring pump according to claim 1, wherein the width of the integrated extension further extends over at least a portion of the pump housing.

* * * * *